United States Patent [19]

Thomson

[11] Patent Number: 4,803,730

[45] Date of Patent: Feb. 7, 1989

[54] FAST SIGNIFICANT SAMPLE DETECTION FOR A PITCH DETECTOR

[75] Inventor: David L. Thomson, Aurora, Ill.

[73] Assignee: American Telephone and Telegraph Company, AT&T Bell Laboratories, Murray Hill, N.J.

[21] Appl. No.: 926,013

[22] Filed: Oct. 31, 1986

[51] Int. Cl.[4] ..... G10L 1/00

[52] U.S. Cl. ..... 381/49; 381/50; 364/513.5

[58] Field of Search ..... 381/29–50; 364/513, 513.5

[56] References Cited

U.S. PATENT DOCUMENTS

| | | | |
|---|---|---|---|
| 4,161,625 | 7/1979 | Katterfeldt et al. | 381/49 |
| 4,282,405 | 8/1981 | Taguchi | 381/49 X |
| 4,282,406 | 8/1981 | Yato et al. | 381/49 |
| 4,561,102 | 12/1985 | Prezas | 381/49 |
| 4,653,098 | 3/1987 | Nakata et al. | 381/49 |

FOREIGN PATENT DOCUMENTS

| | | |
|---|---|---|
| 0237934 | 3/1987 | European Pat. Off. . |
| WO87/01498 | 3/1987 | PCT Int'l Appl. . |

OTHER PUBLICATIONS

The Bell System Technical Journal, vol. 54, No. 2, Feb. 1975, pp. 297 –315, A.T.&T. Co, Rabiner et al, "An Algorithm for Determing the Endpoints of Isolated Utterances".

Pending application, J. Picone, et al, Case 1–4 "A Parallel Processing Pitch Detector", application Ser. No. 770,633, filed on Aug. 28, 1985.

*Primary Examiner*—Patrick R. Salce
*Assistant Examiner*—Emanuel Todd Voeltz
*Attorney, Agent, or Firm*—John C. Moran

[57] ABSTRACT

Improved significant sample detection for a pitch detector for use with speech analysis and synthesis methods by performing a reverse order search and a forward order search of digitized speech samples. A reverse search detector is responsive to segmented digital samples for determining a set of candidate samples by initially selecting one of the digitized samples as a present candidate sample and comparing in reverse order each of the digitized samples with the present candidate sample until a digitized sample is found whose amplitude is greater than the present candidate sample or the compared sample is greater than a predefined number of samples from the present candidate sample. When either of the previous conditions occurs, the compared digital sample becomes the new present candidate sample and the reverse search continues. After the reverse search has been performed and a set of candidate samples has been determined, a forward search detector then initially determines a present significant sample. The latter detector compares this significant sample with each of the candidate samples until a candidate sample is found whose amplitude is greater than the present significant sample or the compared candidate sample is more than a predefined number of samples away from the present significant sample. When either of those conditions occurs, the forward search detector saves the value of the amplitude and location of the candidate sample and replaces the present significant sample with that candidate sample and continues the search.

16 Claims, 3 Drawing Sheets

FAST SIGNIFICANT SAMPLE DETECTION FOR A PITCH DETECTOR

This invention was made with Government support under Contract No. MDA 904-85-C-8032 awarded by Maryland Procurement Office. The government has certain rights in this invention.

TECHNICAL FIELD

This invention relates generally to digital coding of human speech signals for compact storage or transmission and subsequent synthesis and, more particularly, to the determination of significant samples within a digitized voice signal of pitch detection.

PROBLEM

Techniques are known for encoding human speech to reduce the number of bits per second required to store or transmit the encoded speech below the number required for storing or transmitting speech using conventional pulse coded modulation techniques. In order to use encoding techniques that minimizes the number of bits, analog speech samples are customarily partitioned into time frames or segments of lengths on the order of 20 milliseconds in duration prior to final encoding. Sampling of speech is typically performed at a rate of 8 kilohertz (kHz) and each sample is encoded into a multibit digital number. Successive coded samples are further processed in a linear predictive coder (LPC) that determines appropriate filter parameters that model the formant structure of the vocal tract transfer function. The filter parameters can be used to estimate the present value of each signal sample efficiently on the basis of the weighted sum of a preselected number of prior sample values.

The speech signal is regarded analytically as being composed of an excitation signal and formant transfer function. The excitation component arises in the larynx or voice box and the formant transfer function results from the operation of the remainder of the vocal tract on the excitation component. The latter component is further classified as voiced or unvoiced depending upon whether or not there is a fundamental frequency imparted to the airstream by the vocal cords. If the excitation is unvoiced, then the excitation component is simply white noise. If there is a fundamental frequency imparted to the airstream by the vocal cords, then the excitation component is classified as voiced. Pitch detection, i.e., the problem of determining the fundamental frequency of the voiced excitation component, a key parameter, is difficult to perform with a minimal amount of computation.

One method for determining the pitch is given in the application of J. Picone, et al, Case 1–4 "A Parallel Processing Pitch Detector", application Ser. No. 770,633, filed on Aug. 28, 1985, and assigned to the same assignees as the present application. Picone details the utilization of four pitch detectors each responding to a different aspect of the analog speech after various processing techniques. Each pitch detector in Picone consists of a maxima locator, distance detector, and pitch tracker. The function of the maxima locator is to locate significant samples within a speech frame. The latter information is then used by the distance detector and pitch tracker to determine the pitch.

The technique utilized in Picone to locate the set of significant samples within a speech frame is to first scan all of the samples until the maximum sample is found then to repeat the search of the samples until the second largest sample is found. This process continues until a predefined number of samples has been found within the speech frame. It can be shown that this technique requires that the number of scans which must be performed is proportional to the square of the number of samples to be found.

The problem with this technique is that it is extremely time consuming especially if a large number of samples are to found. Whereas, the technique lends itself to implementation on a digital signal processor, DSP, device for certain types of uncomplicated encoding schemes, DSP devices when used for implementing more complicated encoding schemes simply do not have spare computation power available each frame to spare for performing this particular search technique.

SOLUTION

The present invention solves the above described problem and deficiencies of the prior art and a technical advance is achieved by provision of a maxima locator apparatus and method that utilizes a reverse search detector and a forward search detector which are responsive to a speech signal for determining significant samples within the speech signal.

Advantageously, the reverse search detector is responsive to a segment of the digitized speech signal for determining a set of candidate samples by initially selecting one of the digitized samples as a present candidate sample and comparing in reverse order each of the digitized samples with the present candidate sample until a digitized sample is found whose amplitude is greater than that of the present candidate sample or the compared sample is more than a predefined number of samples from the present candidate sample. When either of the previous conditions occurs, the compared sample becomes the new present candidate sample and the reverse search continues. During the reverse search, each of the compared samples that has not replaced the present candidate sample is set equal to zero.

Advantageously, after the reverse search has been performed and a set of candidate samples has been determined, the forward search detector then initially determines a present significant sample from the candidate samples. The latter detector compares the present significant sample with each of the candidate samples until a candidate sample is found whose amplitude is greater than the present significant sample or the compared candidate sample is more than a predefined number of samples away from the present significant sample. When either of those conditions occurs, the forward search detector saves the value of the amplitude and location of the candidate sample and replaces the present significant sample with that candidate sample and continues the search.

Advantageously, the maxima locator further has a threshold detector that is responsive to the significant samples determined by the forward search detector to eliminate all significant samples having an amplitude less than a predefined percentage of the maximum significant sample.

BRIEF DESCRIPTION OF THE DRAWING

These and other advantages of the invention may be better understood from a reading of the following description of one possible exemplary embodiment taken in conjunction with the drawing in which.

DETAILED DESCRIPTION

Figure 1:
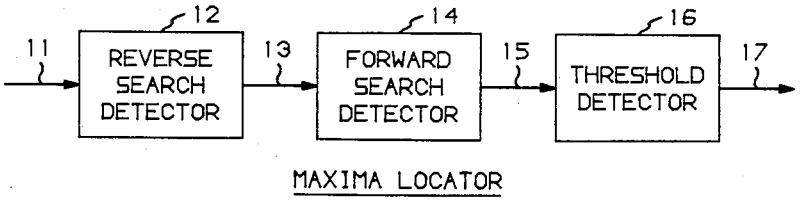
FIG. 1 illustrates, in block diagram form, a maxima locator in accordance with this invention.

FIG. 1 shows an illustrative maxima locator which is the focus of this invention. The maxima locator is responsive to frames of digital samples representing an analog speech signal received via path 11 for determining the significant samples. Those frames of speech are preprocessed in the following manner. In order to reduce aliasing, the speech is first low-pass filtered and then digitized and quantized. The digitized speech is then divided, advantageously, into 20 millisecond frames with each frame comprising, illustratively, 160 samples. Further, it would be obvious to one skilled in the art that the maxima locator could be responsive to other types of signals derived from the analog speech signal that can be utilized to determine the pitch. One such signal is the forward prediction error or residual signal that results during the calculation of the LPC coefficients.

Consider now in detail the operation of maxima locator 10 of FIG. 1. The latter locator is responsive to the samples of the speech frame illustrated in graphic form of FIG. 2 to produce the output signal on path 17 illustrated in FIG. 4. Reverse search detector 12 is responsive to the samples illustrated in FIG. 2. Only a subset of the 160 samples are illustrated. Detector 12 starts with sample 159 and searches from right to left performing the following operations. Detector 12 considers sample 159 a present candidate sample and stores the value of this sample. Detector 12 then examines each sample to the left until it encounters another sample that has an amplitude greater than the present candidate sample or is the nineteenth sample from the present candidate sample being examined. If the larger amplitude sample is encountered or the number of samples examined is equal to 19 samples from the present candidate sample, detector 12 stores that sample as a new present candidate sample and repeats the previous search procedure. The basis for terminating the search after 19 samples and initiating a new search is the assumption that the highest pitch encountered in human speech is approximately 420 Hz which at a sample rate of advantageously 8 kHz results in 19 samples. As detector 12 examines each sample, if that sample is less than the present candidate sample and is within eighteen samples of the present candidate sample, the sample under examination is set to zero.

Figure 2:
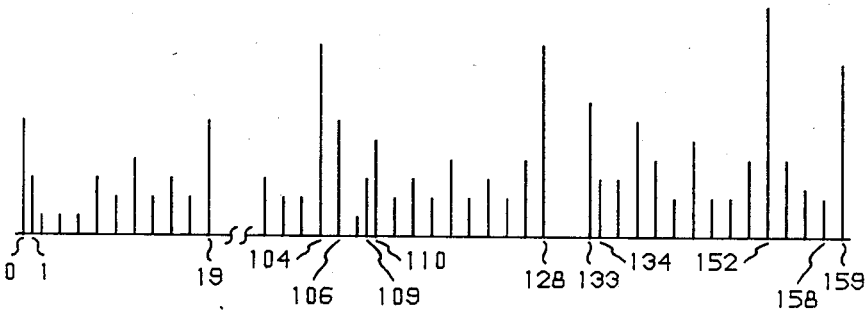
FIG. 2 illustrates, in graphic form, an input digitized speech signal.
Figure 3:
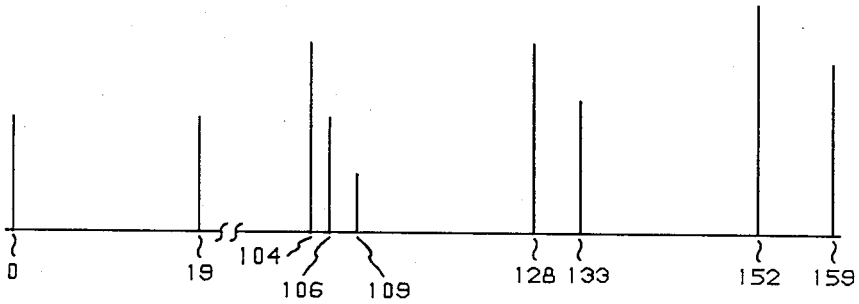
FIG. 3 illustrative, in graphic form, the speech signal after being processed by the reverse search detector of FIG. 1.

Consider now how detector 12 processes the samples illustrated in FIG. 2 to produce the samples illustrated in FIG. 3. Detector 12 starts with sample 159 and proceeds to the left examining each sequential sample. For example, sample 158 is less than 159 so sample 158 is set equal to zero. When detector 12 encounters sample 152, it determines that this sample's amplitude is greater than that of sample 159. The detector then reinitializes the search procedure using sample 152 as the present candidate sample. The search then proceeds from sample 152 until sample 133 is encountered. Since sample 133 is 19 samples from sample 152, sample 133 is utilized as the present candidate sample, and the search proceeds to the left. The results of detector 12 searching to the left and zeroing out samples which do not meet the above search procedure is shown in FIG. 3.

Forward search detector 14 is responsive to the output of reverse search detector 12 to perform the following search procedure from left to right. Starting with sample 0, detector 14 uses sample 0 as the present significant sample and searches each of the samples received from reverse search detector 12 until a sample that is greater than the present significant sample is encountered or more than 18 samples from the present significant sample have been examined. If an examined sample does not meet one of the previously mentioned criteria, it is set equal to zero. When a sample does meet the criteria, the amplitude and the location of the sample are stored and that sample becomes the new present significant sample.

Figure 4:
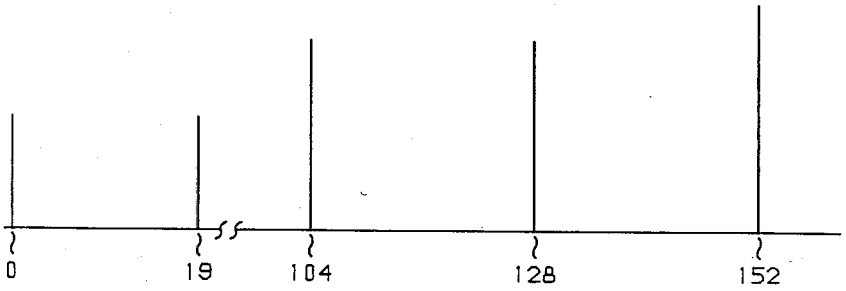
FIG. 4 illustrates, in graphic form, the samples of FIG. 3 after being processed by the forward search detector of FIG. 1.

Consider detector 14's response to the samples illustrated in FIG. 3. Detector 14 starts from sample 0 and search until 18 samples have been exceeded which is sample 18. Sample 19 is recorded as the present significant sample. When detector 14 searches from sample 104, no samples are encountered that are greater than sample 104, sample 128 is designated as the present significant sample, and the search proceeds from sample 128. The results of the forward search detector 14 are shown in FIG. 4. Note, that some samples that had a 0 value are nevertheless designated as significant samples but are not illustrated in FIG. 4. These zero samples are later eliminated by threshold detector 16.

Detector 16 is responsive to the samples illustrated in FIG. 4 to eliminate all samples that are not greater than 25 percent of the amplitude of the largest sample. Threshold detector 16 first determines the maximum sample amplitude and then eliminates all samples whose amplitudes are not greater than 25 percent of this maximum amplitude.

Figure 5:
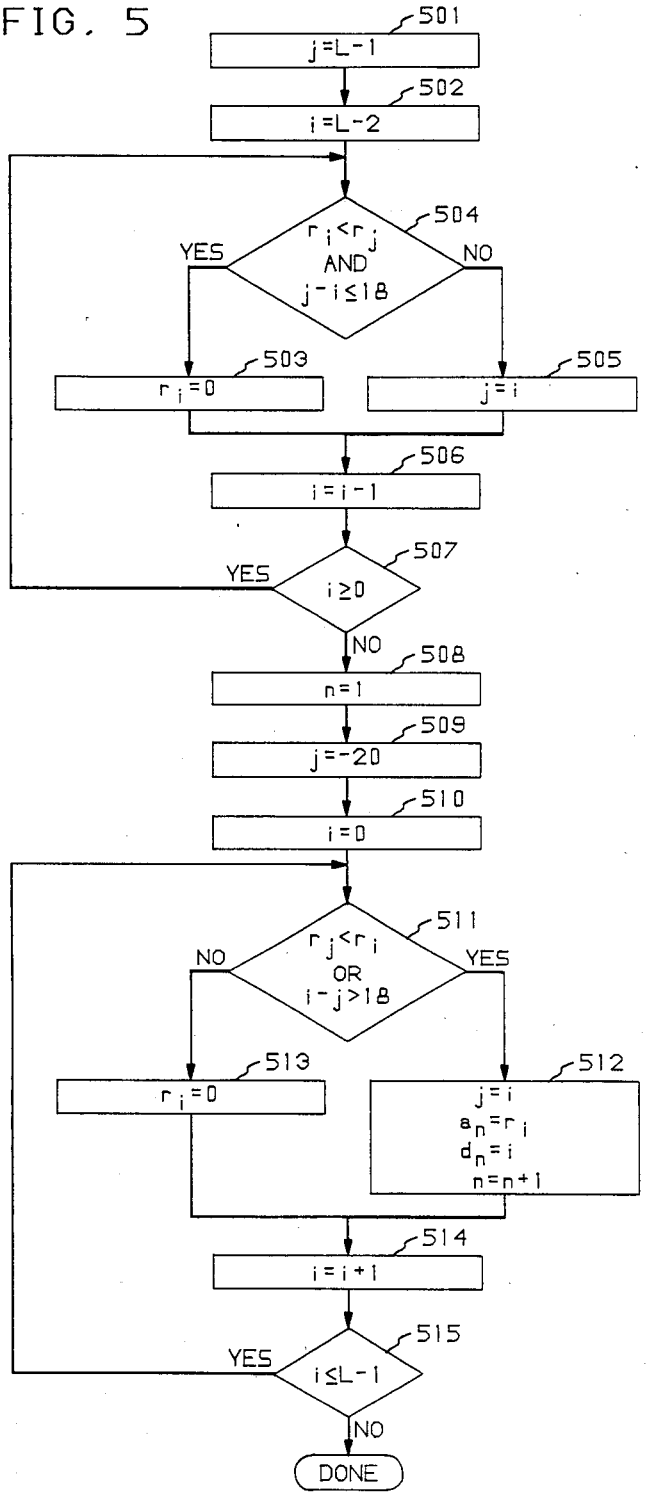
FIG. 5 illustrates, in flow chart form, a program for implementing the maxima locator of FIG. 1.
Figure 6:
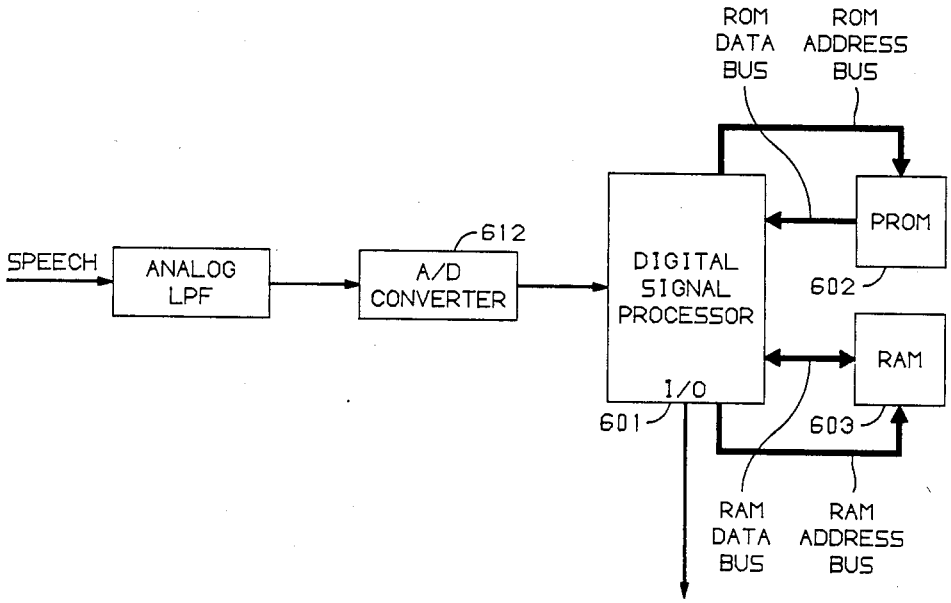
FIG. 6 illustrates a digital signal processor implementation of FIG. 1.

FIG. 5 illustrates, in flow chart form, a program that is used to control a digital signal processor to perform the functions of detectors 12, 14, and 16. Such a digital signal processor system is illustrated in FIG. 6. The digital signal processor system illustrated in FIG. 6 advantageously could use a Texas Instruments' TMS 320-20 digital signal processor. The system illustrated in FIG. 6 also performs the necessary task of low-pass filtering and digital-to-analog conversion. In addition, it provides well known programs for performing the segmentation of the digital samples received from converter 612 into frames. Digital signal processor 601 utilizes PROM 602 and RAM 603 to perform these various functions. The program stored in PROM 602 implements the flow chart shown in FIG. 5.

Consider now in detail the program illustrated in FIG. 5. Blocks 501 through 507 implement reverse search detector 12. Blocks 501 and 502 are utilized to set up the two indexes j and i. The constant L is set equal to the number of samples which advantageously in the present example is 160 samples. The program then proceeds to cycle through blocks 503 to 507 until all of the samples have been examined. The samples are contained in an array which is denoted as r. Decision block 504 makes the decision of whether the amplitude of the present sample being examined is less than the amplitude of the present candidate sample and the range of 18 samples has not been exceeded. If both of these conditions are met, then block 503 is executed which sets the present sample being examined to zero. If the present sample being examined is greater than or equal to the present candidate sample or the range of 18 samples has been exceeded, then the present sample is made the new present sample. Block 506 simply decrements the index being used to cycle through all the samples, and decision block 507 determines whether or not all of the samples have been examined.

Blocks 508 through 515 implement forward search detector 14. The latter detector determines the significant samples and stores the amplitude of those samples in an array a and the location of those samples in an array d with both arrays being indexed by n. Blocks 508, 509 and 510 set up the initial values for the indexes. Decision block 511 determines whether the sample presently under examination is greater than the present significant sample or the range of the sample from the present significant sample is greater than 18 samples. If either of these conditions is true, block 512 is executed resulting in the new present significant sample being made equal to the sample currently under examination and places the latter sample into arrays a and d. Finally, block 512 increments the index n. If these conditions are not met, then block 513 is executed which zeros the sample under examination. Block 514 increments the index i. Decision block 515 makes the determination of whether or not all of the samples have been examined.

The routine illustrated in FIG. 5 is similar to the C source routine detailed in Appendix A. That routine would be part of a pitch detection program which would include the various global variables. The routine of Appendix A is intended for execution on a Digital Equipment Corporation's VAX 11/780-5 computer system or a similar system.

It is to be understood that the afore-described embodiment is merely illustrative of the principles of the invention and that other arrangements may be devised by those skilled in the art without departing from the spirit and the scope of the invention.

APPENDIX A

```
short search()
        short n,j,M,mleft,mright,s,new,p;
        short FLEFT,FRIGHT;
        short A[35],D[35],max,aa,x,aaa,bbb,general();
        short proj;
        pmax=0;
        /* Make T adaptive to pitch */
        if(distd[III]==0) T=6;
        else if(distd[III]<28) T=4;
        else if(distd[III]<60) T=5;
        else if(distd[III]<90) T=6;
        else T=7;
        /* Fast 2-pass pulse finding method */
        j=L-1;
        /*Eliminate small pulses found to left of large*/
        for(i=L-2;i>=0;i--)
        if (r[III][i] < r[III][j] && j-i <= 18) r[III][i]=0;
        else j=i;
        n=1;
        j= -20;
        /*Eliminate small pulses found to right of large*/
        for(i=0;i<=L-1;i++)
        if (r[III][j] < r[III][i]  i-j > 18)
        {j=i;
        a[n]=r[III][i];
        d[n]=i;
        n++;
        }
```

APPENDIX A-continued

```
        else r[III][i]=0;
        /*Now there are n-1 pulses*/
        j=1;
        /*Find max pulse*/
        for(i=2;i<=n-1;i++) if (a[i] > a[j]) j=i;
        max=a[j];
        j=1;
        /*Eliminate pulses < 25% of max*/
        for(i=1;i<=n-1;i++)
        if(a[i] >= (max>>2) && a[i]<0)
        {a[j]=a[i];
        d[j]=d[i];
        j++;
        }
        n=j;
        for(i=1;i<=n-1;++i)
        {A[i]=a[i];
        D[i]=d[i];
        }
        for(i=1;i<n-1;++i)
        {for(j=1;j<n-1;++j)
        {if(A[j]<A[j+1])
        {step=D[j];
        D[j]=D[j+1];
        D[j+1]=step;
        step=A[j];
        A[j]=A[j+1];
        A[j+1]=step;
        }
        }
        }
        for(i=1;i<n;++i) if(a[i]==A[1]) }
        ss=i;
        break;
        }
}
```

What is claimed is:

1. An apparatus responsive to a digitized signal comprising a plurality of segments each having a plurality of samples for determining a set of significant samples from said digitized signal, comprising:

means for searching in reverse order through said samples of one of said segments to determine a set of candidate samples; and means for searching in a forward order through said set of candidate samples to determine a set of significant samples for said one of said segments.

2. The apparatus of claim 1 wherein the reverse order search means comprises means for initially obtaining a present candidate sample;

means for sequentially accessing in reverse order each of said samples of said one of said segments;

means for comparing each of the accessed samples with said present candidate sample;

means for identifying the compared sample as said present candidate sample upon said compared sample being greater than said present candidate sample; and said means for identifying further responsive to said compared sample being more than a predefined number of samples from said present candidate sample for identifying said compared sample as said present candidate sample.

3. The apparatus of the claim 2 wherein said identifying means comprises means for assigning the amplitude of each of said compared samples equal to zero upon said compared signal sample being less than said present candidate sample or when said predefined number of samples from said present candidate sample is exceeded.

4. The apparatus of claim 1 wherein said forward searching means comprises means for initially obtaining a present significant sample;

means for sequentially accessing each of said candidate samples;

means for comparing each of said accessed candidate samples with said present significant sample;

means for identifying the compared sample as said present significant sample upon said compared sample having a greater amplitude than said present significant sample; and said identifying means further responsive to the compared sample being more than a predefined number of samples from said present significant sample for identifying said compared sample as said present significant sample.

5. The apparatus of claim 4 wherein said means for identifying further comprises means for storing each of the compared samples amplitude and location upon the compared sample becoming said present significant sample.

6. The apparatus of claim 5 wherein said identifying means further comprises means for assigning each of said candidate sample to zero upon each of said candidate samples not becoming said present significant sample.

7. The apparatus of claim 1 further comprises means for assigning significant samples of said set of significant samples having an amplitude less than a predefined percentage of the maximum significant sample to zero.

8. The apparatus of claim 7 wherein said assigning means comprises means for determining said maximum significant sample; and means responsive to said maximum significant sample for eliminating the significant samples less than a predefined percentage of said maximum significant sample.

9. A method for determining a set of significant samples from a digitized signal in response to a segment of said digitized signal, said method comprising:

searching in reverse order through said samples of said segment to determine a set of candidate samples; and searching in a forward order through said set of candidate samples to determine said set of significant samples.

10. The method of claim 9 wherein said reverse order search step comprises the steps of initially obtaining a present candidate sample;

accessing in a reverse sequential order each of said samples of said segment;

comparing each of the accessed samples with said present candidate sample;

identifying the compared sample as said present candidate sample upon said compared sample being greater than said present candidate sample; and said identifying step further responsive to said compared sample being more than a predefined number of samples from said present candidate sample for identifying said compared sample as said present candidate sample.

11. The method of claim 10 wherein said step of identifying comprises the steps of assigning the amplitude of each of said compared samples equal to zero upon said compared sample being less than said present candidate sample or when said predefined number of samples from said present candidate sample is exceeded.

12. The method of claim 9 wherein said forward searching step comprises the steps of initially obtaining a present significant sample;

sequentially accessing each of said candidate samples from said present significant sample;

comparing each of said accessed candidate samples with said present significant sample;

identifying the compared sample as said present significant sample upon said compared sample having a greater amplitude than said present significant sample; and said step of identifying further responsive to the compared sample being more than a predefined number of samples from said present significant sample for identifying said compared sample as said present significant sample.

13. The method of claim 12 wherein said step of identifying further comprises the step of storing each of said compared samples'amplitude and location upon the compared sample becoming said present significant sample.

14. The method of claim 13 wherein said step of identifying further comprises the steps of assigning each of said candidate samples to zero upon each of said candidate samples not replacing said present significant sample.

15. The method of claim 9 further comprises the step of assigning significant samples of said set of significant samples having an amplitude less than a predefined percentage of the maximum significant sample to zero.

16. The method of claim 15 wherein said assigning step further comprises the steps of determining said maximum significant sample; and eliminating the significant samples less than a predefined percentage of said maximum significant sample in response to said maximum significant sample.

* * * * *